United States Patent [19]

Corwin

[11] Patent Number: 4,999,158

[45] Date of Patent: Mar. 12, 1991

[54] OXIDATION RESISTANT IRON BASE ALLOY COMPOSITIONS

[75] Inventor: John M. Corwin, Royal Oak, Mich.

[73] Assignee: Chrysler Corporation, Highland Park, Mich.

[21] Appl. No.: 267,689

[22] Filed: Nov. 2, 1988

Related U.S. Application Data

[63] Continuation of Ser. No. 938,179, Dec. 3, 1986, abandoned.

[51] Int. Cl.[5] ..... C22C 37/10; C22C 30/00; C22C 37/00; C22C 38/00

[52] U.S. Cl. ..... 420/8; 420/40; 420/41; 420/43; 420/50; 420/84; 420/119; 420/581; 420/583

[58] Field of Search ..... 420/8, 40, 41, 43, 50, 420/84, 119, 581, 583

[56] References Cited

U.S. PATENT DOCUMENTS

| | | | |
|---|---|---|---|
| Re. 24,242 | 12/1956 | Lohr | 75/171 |
| Re. 24,243 | 12/1956 | Lohr | 75/171 |
| Re. 31,339 | 8/1983 | Dardi et al. | 148/4 |
| 648,428 | 5/1900 | Patrick | 420/441 |
| 1,653,530 | 6/1927 | Kiam | 420/558 |
| 1,920,934 | 8/1933 | Keen | 75/1 |
| 1,962,599 | 6/1934 | Keen | 75/1 |
| 2,553,330 | 5/1951 | Post | 420/40 |
| 2,580,171 | 12/1951 | Hägglund et al. | 420/40 |
| 2,684,298 | 7/1954 | Henke | 420/40 |
| 3,027,252 | 3/1962 | McGurty et al. | 420/40 |
| 3,031,297 | 4/1962 | Baranow | 420/40 |
| 3,298,826 | 1/1967 | Wukusick | 420/40 |
| 3,591,371 | 7/1971 | Hatwell et al. | 420/588 |
| 3,676,085 | 7/1972 | Evans et al. | 420/588 |
| 3,729,308 | 4/1973 | Eiselstein et al. | 420/40 |
| 3,754,898 | 8/1973 | McGurty | 420/40 |
| 3,852,063 | 12/1974 | Niimi | 420/40 |
| 3,859,060 | 1/1975 | Eiselstein et al. | 420/443 |
| 3,865,581 | 2/1975 | Sekino et al. | 420/40 |
| 4,022,587 | 5/1977 | Wlodek | 420/443 |
| 4,053,308 | 10/1977 | Tesk et al. | 420/443 |
| 4,094,671 | 6/1978 | Hayashi | 420/477 |
| 4,102,677 | 7/1978 | Deverell | 420/40 |
| 4,133,680 | 1/1979 | Babaskin | 420/443 |
| 4,141,762 | 2/1979 | Yamaguchi et al. | 420/40 |
| 4,157,923 | 6/1979 | Yen et al. | 148/4 |
| 4,159,908 | 7/1979 | Rao et al. | 420/565 |
| 4,201,577 | 5/1980 | Ingersoll et al. | 420/587 |
| 4,224,064 | 9/1980 | Bilek et al. | 420/425 |
| 4,322,248 | 3/1982 | Patrician et al. | 420/429 |
| 4,388,125 | 6/1983 | Benn | 420/443 |
| 4,399,096 | 8/1983 | Agarwal et al. | 420/463 |
| 4,400,209 | 8/1983 | Kudo et al. | 420/452 |
| 4,400,211 | 8/1983 | Kudo et al. | 420/452 |
| 4,411,864 | 10/1983 | Morikawa et al. | 420/587 |
| 4,472,197 | 9/1984 | Bilek et al. | 420/25 |
| 4,545,817 | 10/1985 | Bilek et al. | 420/83 |
| 4,572,750 | 2/1986 | Masumoto et al. | 420/443 |
| 4,600,556 | 7/1986 | Donachie et al. | 420/542 |
| 4,612,166 | 9/1986 | Brock et al. | 420/490 |
| 4,636,357 | 1/1987 | Peel et al. | 420/532 |
| 4,652,299 | 3/1987 | Bienvenu et al. | 420/590 |
| 4,717,539 | 1/1988 | Morisey | 420/457 |

FOREIGN PATENT DOCUMENTS

| | | | |
|---|---|---|---|
| 1927334 | 12/1970 | Fed. Rep. of Germany . | |
| 55-24910 | 2/1980 | Japan . | |
| 55-73847 | 6/1980 | Japan . | |
| 56-33447 | 3/1981 | Japan . | |
| 56-41345 | 4/1981 | Japan . | |
| 60-36644 | 2/1985 | Japan . | |
| 60-36645 | 2/1985 | Japan . | |
| 60-247036 | 12/1985 | Japan . | |
| 60-247037 | 12/1985 | Japan . | |
| 0126730 | 1/1960 | U.S.S.R. . | |
| 0430180 | 11/1974 | U.S.S.R. . | |
| 579339 | 11/1977 | U.S.S.R. . | |
| 619537 | 7/1978 | U.S.S.R. . | |
| 679637 | 8/1979 | U.S.S.R. . | |
| 0700556 | 11/1979 | U.S.S.R. . | |
| 1148893 | 4/1985 | U.S.S.R. . | |
| 1157111 | 5/1985 | U.S.S.R. . | |
| 1157115 | 5/1985 | U.S.S.R. . | |
| 1170001 | 7/1985 | U.S.S.R. . | |
| 1178790 | 9/1985 | U.S.S.R. . | |
| 1184865 | 10/1985 | U.S.S.R. . | |
| 1188219 | 10/1985 | U.S.S.R. . | |
| 1194632 | 11/1985 | U.S.S.R. . | |
| 1203124 | 1/1986 | U.S.S.R. . | |
| 1216240 | 3/1986 | U.S.S.R. . | |
| 1235981 | 6/1986 | U.S.S.R. . | |
| 1258871 | 9/1986 | U.S.S.R. . | |
| 1266889 | 10/1986 | U.S.S.R. . | |
| 1266891 | 10/1986 | U.S.S.R. . | |
| 1266892 | 10/1986 | U.S.S.R. . | |
| 2036793 | 7/1980 | United Kingdom | 420/443 |

OTHER PUBLICATIONS

"Understanding Alloys' High Temperature Oxidation Resistance", *MIT Report*, p. 13 (Mar., 1987).

Dearnaley, "Applications of Ion Implantation in Metals and Alloys", *IEEE Transactions on Nuclear Science*, NS-28:2 (Apr., 1981).

Article entitled: "The Design of Optimum Multifactorial Experiments"; by R. L. Plackett and J. P. Burman from *Biometrika*, 1946, pp. 305–327.

Article entitled: "Some Generalizations in the Multifactorial Design"; by R. L. Plackett from *Biometrika*, 1946, pp. 328–332.

(List Continued on next page.)

*Primary Examiner*—Theodore Morris, III
*Assistant Examiner*—David W. Schumaker
*Attorney, Agent, or Firm*—Mark P. Calcaterra

[57] ABSTRACT

This invention relates to iron-base alloy compositions, nickel containing austenitic ferrous alloy compositions (especially low nickel compositions) and dopants added to low nickel austenitic alloys as a means of improving the elevated temperature oxidation resistance of the resultant material.

49 Claims, No Drawings

OTHER PUBLICATIONS

Article entitled: "Table of Percentage Points of the T-Distribution", by E. M. Baldwin from *Biometrika,* 1946, p. 362.

Article entitled: "Industrial Statistics", by W. Volk from *Chemical Engineering,* Mar., 1956.

*Metals Handbook,* Eighth Edition, vol. 2, Lyman, pp. 507-516.

*Materials Science & Engineering,* vol. 70, Appleton et al., pp. 23-51 (1985).

Society of Automotive Engineers (SAE) Paper No. 740093 by A. Roy, F. A. Hagen and J. M. Corwin entitled, "Performance of Heat-Resistant Alloys in Emission-Control Systems", (1974).

OXIDATION RESISTANT IRON BASE ALLOY COMPOSITIONS

This is a continuation of U.S. Pat. application Ser. No. 938,179, filed Dec. 3, 1986 entitled "Oxidation Resistant Iron Base Alloy Compositions" now abandon.

BACKGROUND AND SUMMARY OF THE INVENTION

This invention relates to iron-base alloy compositions and methods for preparing these compositions. In a preferred embodiment, the compositions and methods relate to nickel containing austenitic ferrous alloy compositions, especially low nickel compositions. In a more preferred aspect, this invention relates to dopants added to low nickel austenitic alloys as a means of improving the elevated temperature oxidation resistance. This invention may be extended to apply to cast alloys.

Low nickel ferrous alloys containing chromium and having nickel present in amounts of about 5 to 15 percent by weight and having manganese, nitrogen and carbon present to aid in forming and stabilizing any austenite present are known.

Compared to traditional cast iron construction, sheet metal automotive exhaust system parts would offer the advantages of both lighter weight and reduced thermal mass. To maximize these advantages, the metal thickness of wrought automotive engine parts such as thermal reactors and turbocharger housings, should be minimized. This can be accomplished by constructing the engine parts from stainless steels, austenitic where hot strength is required, and with alloying suitable for resistance to deterioration by engine exhaust gases on the inside surface of the engine parts and atmospheric air on the outside surface of the engine parts where the surface operating temperature is at a maximum. Such a construction is not cost effective because the resistance to oxidation of the lower cost stainless steel sheet metal alloys at elevated temperatures of 1,500 degrees F to 2,200 degrees F is not sufficient to allow their use in applications where the alloy is exposed to the combustion products normally formed by gasoline fueled internal combustion engines. Because the presently available low-cost alloys do not resist oxidation in elevated temperature combustion environments, it is necessary to use a more expensive alloy with a higher nickel and/or chromium content in automotive emission control devices such as thermal reactors. Therefore, the limitation to using currently available, adequate alloy content stainless steels is the high cost and excessive strategic element content.

Degradation of alloy materials, such as stainless steels, at elevated temperatures is largely dependent on the protective capacity of surface oxide films formed from the alloy during exposure to heat in oxygen containing atmospheres. In one respect, this invention deals with an effective method of improving the protective capacity of oxide scales formed on alloy materials such as low nickel austenitic stainless steels.

By way of summary, the compositions of the present invention relate to the discovery that certain elements can be added to iron-base alloy materials to dramatically improve their resistance to oxidation. More particularly, the invention relates to the discovery that the addition of these elements (referred to herein as "dopants") yields lower cost materials suitable for use in heretofore impractical environments. The compositions of the present invention comprise iron-base alloy compositions exhibiting improved resistance to oxidation comprising:

(i)iron;

(ii) at least one alloy element selected from the group consisting of nickel, chromium, molybdenum, manganese, silicon, carbon, vanadium, cobalt, copper, nitrogen, aluminum, titanium, zirconium, and mixtures thereof; and (iii) an effective amount of a dopant selected from the group consisting of lithium, sodium, potassium, yttrium, lanthanum, cerium, calcium, magnesium, barium, aluminum, beryllium, strontium, and mixtures thereof.

The oxidation problems of the currently available alloy materials can be overcome by using alloy materials, such as low nickel austenitic (LNA) stainless steel alloys containing chromium and ferritic stainless steel alloys containing medium to high levels of chromium with the additions of an effective amount, preferably at least about 0.02, and more preferably about 0.1 to 2 percent by weight, of the dopants or doping elements or alloys disclosed herein. Alloy compositions of the present invention would be made in a conventional manner, i.e., typical of the alloy content without the dopant of the present invention, but with provision for the addition of dopant elements, in the melt process or later, in later alloy processing, or by surface treatment.

In the preferred alloys of the present invention, according to this invention, barium, calcium, lithium, lanthanum/cerium, magnesium, potassium and sodium or mixtures thereof are added to the alloy as dopants.

The methods disclosed herein involve the addition of small quantities of elements (appearing for the most part in Groups IA, IIA, and IIB of the Periodic Table of Elements) to the base alloy composition. These elements, as ions, enter into the protective oxide scale and modify predominantly anion and to a lesser extent cation transport through the oxide scale, greatly reducing the amount of oxidation observed due to elevated temperature exposure.

Research leading to this invention was based upon low nickel austenitic (LNA) compositions and was guided by extensive use of experimental design. Initially, a 28 run balanced orthogonal array fractional factorial scheme according to Plackett and Burman was employed as a screening method to identify main-effect influences on oxidation resistance of 26 constituents from the Periodic Table of Elements. For this work, reference was made to an article entitled "The Design Of Optimum Multifactorial Experiments" by R. L. Plackett and J. P. Burman (*Biometrika,* 1946, pages 305–327) which is hereby expressly incorporated by reference; an article entitled "Some Generalizations In The Multifactorial Design" by R. L. Plackett (*Biometrika,* 1946, pages 328–332) which is hereby expressly incorporated by reference; and to an article entitled "Table Of Percentage Points Of The T-Distribution" by Elizabeth M. Baldwin (*Biometrika,* 1946, page 362) which is also hereby expressly incorporated by reference. Selection criteria for elements to be considered included commercial availability in quantities sufficient to support volume alloy production, cost and subject reasoning as to the elements' ability to be a stable part of the alloy composition. Fitting these 26 constituents into the 28 run experimental design left 2 columns for random variation or error determination. The Table I lists these constituents by Periodic Table groupings. Note that La-Ce is considered as one constituent because these two elements co-exist as a commercial rare-earth product. Table II lists elements considered as part of the base composition and therefore not included in the oxidation improvement design scheme.

TABLE I

| Periodic Table Group | Constituent |
|---|---|
| IA | Li, Na, K |
| IIA | Be, Mg, Ca, Sr, Ba |
| IIIA | B, Al |
| IVA | Si, Sn |
| VA | Pb, Sb, Bi |
| IB | Cu |
| IIB | Zn |
| IIIB | Y, La—Ce |
| IVB | Ti, Zr |
| VB | V, Nb, Ta |
| VIB | Mo, W |

TABLE II

| Periodic Table Group | Constituent |
|---|---|
| IVA | C |
| VA | N |
| VIB | Cr |
| VIIB | Mn |
| VIII | Fe, Co, Ni |

Elements associated with improvements in oxidation resistance, as determined by the Plackett-Burman experimental design, were then incorporated in full factorial experimental designs of the form $2^3$ to $2^6$ for identification of interactions and $3^2$ to $3^3$ for quantifying certain effects. The notation $Y^X$ refers to X factors evaluated at Y levels each for a total of $Y^X$ test runs. Similar notations and documentation of full factorial experimental designs and analysis can be found in the literature. For this work, reference was made to "Industrial Statistics" by W. Volk (*Chemical Engineering*, March 1956) which is hereby expressly incorporated by reference. Interactions in this context are those situations wherein the main effect between certain variables change as a function of changes in other variables.

In the course of this research, it was found that elements within the alloy functioned in three identifiable ways: Austenite Stabilizers, Oxide Formers and Oxide Dopants. Understanding of these functions is helpful in describing the alloys of this invention.

Austenite Stabilizers. Alloys of this invention are designed to maintain a stable austenitic matrix at use temperatures up to 2200 degrees F. Elements identified as promoting this austenite stability are Mn, Co, Ni, Cu, C, Sn, Sb, Bi and N. Throughout the course of this alloy development, it was necessary to periodically adjust the choice and quantity of austenite stabilizer elements to balance the counteracting effects of La-Ce, Ti, Zr, V, Cr, Al and Si as these elements were introduced or changed in concentration as part of the effort to determine their effect on oxidation resistance.

Oxide Formers. An object of this invention is to improve the protective nature of surface oxides formed during exposure to elevated temperatures and, therefore, a stable surface oxide is required. Elements identified as significant contributors to stable surface oxide formation on these iron base alloys are: Cr, Co, Ni, Al and Si. The elements Cr, Co and Ni were, individually or in combination, part of the base composition, Table II, and therefore not subject to evaluation during the fractional factorial phase of this investigation. Al and Si were incorporated into the initial experimental design (Table I) and were determined to contribute to improved oxidation resistance through interaction with dopant elements. This interaction is interpreted to be due to the contribution of Al and Si in formation of stable surface oxides.

Dopants. Dopants are elements found to have a major effect on the protective nature of the host oxide. Typically, they are found in groups IA, IIA and IIIB of the Periodic Table of Elements and include, without limitation, those described herein, as well as mixtures of these materials. Their function in improving oxidation resistance is judged to be due to their effect on predominantly anion and to a lesser extent cation transport through the surface oxide film.

DESCRIPTION OF THE DRAWINGS

Other objects, features and advantages of the present invention will become more fully apparent from the following detailed description of the preferred embodiment, the appended claims and in the accompanying drawings in which:

FIG. 5 shows a photomicrograph of LNA alloy after 1,600 hours in the 1800–1950 degrees F zone of the engine installation shown in FIG. 3;

FIG. 6 shows a photomicrograph of commercial RA333 alloy after 1600 hours in the 1800–1950 degrees F zone of the engine installation shown in FIG. 3.

DETAILED DESCRIPTION OF THE PREFERRED EMBODIMENT

Figure 1:
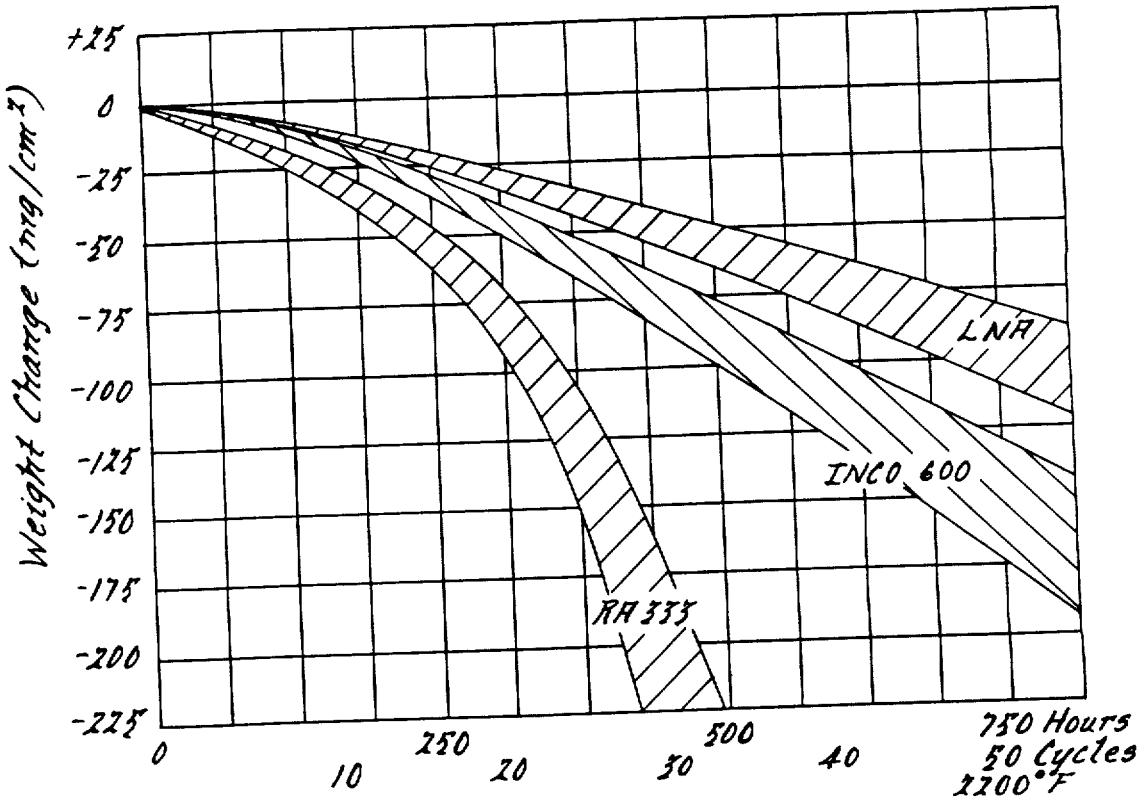
FIG. 1 graphs the still-air cyclic oxidation resistance of LNA with other commercical high-temperature alloys at 2,200 degrees F (1,204 degrees C.)

All percentages herein are by weight of the final composition, unless otherwise indicated.

This is one of four applications all filed on the same day. All of the applications deal with related inventions. They are commonly owned and have the same inventor. The claims, drawings and description in each applicatio are unique, but incorporate the others by reference. Accordingly, the following three applications are hereby expressly incorporated by reference: "Method of Preparing Oxidation Resistant Iron Base Alloy Compositions"; "Non-Iron Base Alloy Compositions"; and "Method of Preparing Non-Iron Base Alloy Compositions." These are now, respectively, U.S. Ser. No. 938,180; U.S. Ser. No. 938,182; and U.S. Ser. No. 938,181.

The compositions produced by the methods of the present invention demonstrate many advantages over art-disclosed compositions including, without limitation, excellent strength; amenability to mass production techniques such as forming, joining and the like; and excellent resistance to oxidation under extreme conditions such as high temperatures.

The compositions of the present invention relate to the discovery that certain elements can be added to iron-base alloy materials to dramatically improve their resistance to oxidation. More particularly, the invention relates to the discovery that the addition of these elements (referred to herein as "dopants") yields materials suitable for use in heretofore impractical environments thereby avoiding the use of expensive, higher alloy-content materials. The compositions of the present invention comprise iron-base alloy compositions exhibiting improved resistance to oxidation comprising:

(i) iron;

(ii) at least one alloy element selected from the group consisting of nickel, chromium, molybdenum, manganese, silicon, carbon, vanadium, cobalt, copper, nitrogen, aluminum, titanium, zirconium, and mixtures thereof; and (iii) an effective amount of a dopant selected from the group consisting of lithium, sodium, potassium, yttrium, lanthanum, cerium, calcium, magnesium, barium, aluminum, beryllium, strontium, and mixtures thereof.

Such methods of addition are known in the art. For example, effective methods of surface modification and/or surface coating are disclosed in *Metals Handbook*, Eighth Edition, Volume 2, Lyman, pages 507–516; and *Materials Science and Engineering*, Volume 70, Appleton et al., pages 23–51; both of which are expressly incorporated herein by reference.

By the term "iron-base", as used herein, is meant that iron is the predominate alloy element present, by weight of the final composition. Thus, while one or more other alloy elements may be employed, iron may be present at a level greater than any other single element by weight. Iron need not comprise 50 percent of the composition; by way of illustration (without limitation), a composition comprising 30 percent iron, by weight, and 29 percent nickel by weight, as well as other elements each being less than 30 percent by weight, but in aggregate totaling more than 50 percent by weight (including the nickel), would be iron-base as defined herein.

By the term "effective amount", as used herein, it is meant an amount of the dopant sufficient to show a significant and reproducible improvement in one or more oxidation-resistant properties of the final compositions. Such properties would include weight change, surface appearance as measured by gross observation and micro observation by metallography as described herein. For example, when two alloy compositions, differing in only that one contains an effective amount of a dopant, and the other containing less than an effective amount or no dopant are compared, the alloy containing an effective amount will demonstrate a significant and reproducible improvement in one or more oxidation-resistant properties.

Preferred alloy elements include those selected from the group consisting of silicon, nickel, chromium, cobalt, manganese, nitrogen, and mixtures thereof. Silicon, nickel, and chromium are particularly preferred.

Iron, as well as the alloy elements desenbed above, can be employed at levels generally known in the art. For example, the dopants of the present invention may be employed in AISI types 201, 202, 301, 302, 302B, 303, 303Se, 304, 304L, 305, 308, 309, 309S, 310, 315, 316, 316L, 317, 321, 347, 348, 384 and 385 austenitic stainless steels. Employing the dopants of the present invention, in addition to the elements at levels conventionally employed (except for small modifications to maintain matrix stability, if needed) in such AISI materials produces materials which can then be employed in heretofore impossible or impractical environments or applications. Also, the compositions prepared by the methods of the present invention can also employ lower levels of stategic or expensive elements than generally disclosed in the art, but at the same time demonstrating equivalent or improved oxidation resistant properties. Stainless steel (RA 333) and non-stainless steel (INCO 330) may also employ the dopants of the present invention.

Preferred compositions include those where nickel is present at a level of about 5 to about 15 percent, and where chromium is present at a level of about 10 to about 30 percent, by weight of the final composition.

The compositions and methods of the present invention employ an effective amount of a dopant. Preferred dopants are primarily selected from the group consisting of elements from Groups IA, IIA, IIIB of the Periodic Table of Elements. These include lithium, sodium, potassium, yttrium, lanthanum, cerium, calcium, magnesium, barium, aluminum, beryllium, and strontium. Mixtures of such materials may also be employed. Highly preferred materials include lithium, sodium, potassium, yttrium, lanthanum, cerium, calcium, magnesium, barium, aluminum and mixtures thereof.

Preferred mixtures include magnesium and calcium with lithium, sodium, potassium, lithium and sodium, and lithium and potassium.

As stated, the dopant is employed in the compositions and methods of the present invention in an effective amount. Such a level will vary with many factors, including, without limitation, the level of the various other elements, materials or impurities present, such as iron, nickel, chromium and the like, as well as the desired improvement in oxidation resistance. The selection of such a level is well within the skill of the artisan in light of the present disclosure and teachings.

It should be noted that aluminum can play many roles in the compositions of the present invention. It can be used as an effective dopant when employed at levels below that at which it acts as a bulk oxide former.

In general, the dopant is present at a level of about at least about 0.02 percent, by weight of the final composition.

In a preferred embodiment, the dopant is present at a level of about 0.05 to about 5 percent; still more preferably at a level of about 0.1 to about 3.5 percent; and still more preferably at a level of about 0.1 to about 2.0 percent.

In a highly preferred embodiment, the dopant comprises magnesium, calcium, lithium, sodium, and potassium; the magnesium is present at a level of about 0.1 to about 1.5 percent; the calcium is present at a level of about 0.1 to about 1.5 percent; the lithium is present at a level of about 0.1 to about 0.5 percent; the sodium is present at a level of about 0.1 to about 0.5 percent; the potassium is present at a level of about 0.5 to about 1.0 percent.

Typically, an alloy of this invention would be made with about 20 to 30 percent by weight chromium, about 0.1 to 1.5 percent by weight carbon, about 3 to 4 percent by weight manganese, about 0 to 12 percent by weight cobalt, about 5 to 15 percent by weight nickel and about 0.5 to 2 percent by weight dopant, with the balance being iron and normal residual impurities.

In general, the alloys of this invention can be described as oxidation resistance steels having iron as the base material with the addition of chromium and other alloying elements to increase oxidation resistance. The preferred alloys of this invention have a stable austenitic structure with the further feature that they contain minor quantities of dopant elements. Nickel, cobalt, nitrogen, carbon and manganese are strong austenite stabilizers in ferrous alloys and the concentration of one or more of these elements in the alloy should be maintained at a level high enough to ensure that the alloy's structure remains austenitic over the temperature range normally encountered by parts formed from the alloy.

These alloys are alluded to in an SAE Paper No. 740093 by A. Roy, F. A. Hagen and J. M. Corwin entitled "Performance Of Heat Resistant Alloys In Emission-Control Systems", which is hereby expressly incorporated by reference.

Alloying element ranges of 3 to 4 percent by weight, manganese; 5 to 15 percent by weight, nickel; 0 to 12 percent by weight, cobalt; 0.1 to 0.5 percent by weight, nitrogen; and 0.5 to 1.5 percent by weight, carbon provide good austenite stabilizing levels in normal ferrous alloys.

Because excessive manganese (an austenite stabilizer) promotes the formation of a thick non-adherent oxide which spalls off and promotes further oxidation, its concentration in the alloys of this invention is needed but controlled to lessen the tendency for oxide spalling consistent with other requirements like formability, weldability and strength.

Many experimental alloys of this invention were made in the Metallurgical Research Laboratory of Chrysler Corporation. Where possible, ferroalloys, scrap alloy and other commercial charge materials were employed. Charge compositions were calculated with the aid of computerized linear analyses with the constraint that minimum cost combinations giving the specified alloy composition be selected.

Heat sizes were either 2500 or 5000 grams with resulting ingots weighing approximately 1800 grams. These ingots were hot forged and/or hot rolled into slabs with sufficient thermal-mechanical working to destroy the original cast microstructure. Hot and cold rolling, with inter-stage annealing was employed to produce final strip form, typically 0.030" thick. Special melting procedures were employed for the addition of Mg wherein Mg metal or NiMg was encased in iron foil and plunged into the melt to facilitate high recovery levels of Mg. For convenience, halogen salts of Li, Na, K, Mg, Ca, Sr and Ba were often employed for small quantity (less than 1 percent) additions of these elements.

In the description of alloying and doping agents hereinafter, all percentages are by weight unless specifically noted.

The magnesium dopant modified silicon-containing alloys show an average oxidation resistance improvement at 2,200 degrees F of 24 percent compared to the undoped base composition. Further addition of calcium dopant yields a 36 percent improvement compared to the undoped base composition. Introduction of sodium, lithium, potassium, barium and lanthanum/cerium dopants, in addition to magnesium and calcium results in an average oxidation resistance improvement at 2,200 degrees F. of 78 percent compared to the undoped base composition.

Procedures used to evaluate experimental and commercial alloys range from simple still air cyclic oxidation tests with small coupons in laboratory furnaces, to vehicle tests with full size components. In order to evaluate the austenitic alloys herein disclosed, several of the following tests were performed: still-air cyclic oxidation in laboratory furnaces; cyclic endurance tests on engines loaded by dynamometers; controlled exhaust environment tests in tube furnaces; component endurance tests on engines loaded by dynamometers; and on-vehicle tests at the proving grounds for durability.

Some of the more promising commercial alloys which were tested and compared to the LNA alloy, as determined from the still-air cyclic oxidation test, were run in the exhaust system of a dynamometer engine under closely controlled conditions simulating vehicle exhaust compositions. Additional tests were made in a laboratory tube furnace supplied with a vehicle-like exhaust atmosphere produced by a single-cylinder engine. The component endurance and vehicle durability tests were designed to evaluate different alloys as integral parts of full size components installed on test cell or vehicle engines.

The still-air cyclic oxidation tests were conducted in laboratory muffle type furnaces at temperatures ranging from 1,350 to 2,200 degrees F. Small test panels, 1"×2"×0.030" thick, were hung on racks that were cycled twice a day between room temperature and the furnace test temperature. Weight changes were recorded periodically after a light brushing to remove loose oxide. Weight change data were recorded in a similar manner from the samples evaluated in engines and controlled exhaust environmental tests in tube furnaces.

Component endurance tests in both dynamometer engines and vehicles were evaluated on the basis of component failure due to perforation or gross oxidation to the extent that the component was no longer serviceable. Typically, metallographic examination for oxidation type (surface, internal or both) and remaining metal thickness was conducted on these components following removal from test. The results were reported as a unit weight change—either plus or minus. Loose scale was not collected, nor were the samples chemically de-scaled prior to the weighing.

Weight change data by itself can be quite misleading when comparing several different alloys if the mode of corrosive attack is not similar in each case. Metallography was used in most cases to supplement weight change data. Photomicrographs, therefore, are required to illustrate the point.

Referring to FIG. 1, shown are graphs of the still-air cyclic oxidation resistance of LNA with other commercial high-temperature alloys at 2200 degrees F. The LNA alloy outperforms the stainless steel (RA 333) and non-stainless steel (INCO 330) samples (commercial high nickel alloys marketed by Rolled Alloys and International Nickel, respectively) in exhibiting the least weight change over the cycles of testing.

Figure 2:
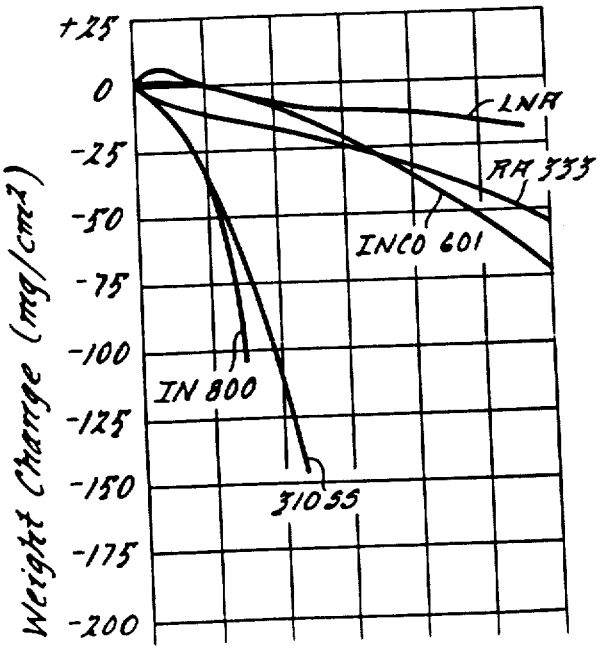
FIG. 2 graphs the still-air cyclic oxidation resistance of LNA with other commercial high-temperature alloys at 1,900 degrees F (1,038 degrees C.)

Referring to FIG. 2, similar results are found during still-air cyclic oxidation testing at 1900 degrees F. where LNA is compared with RA 333, INCO 601, IN 800 and 310 SS.

Figure 3:
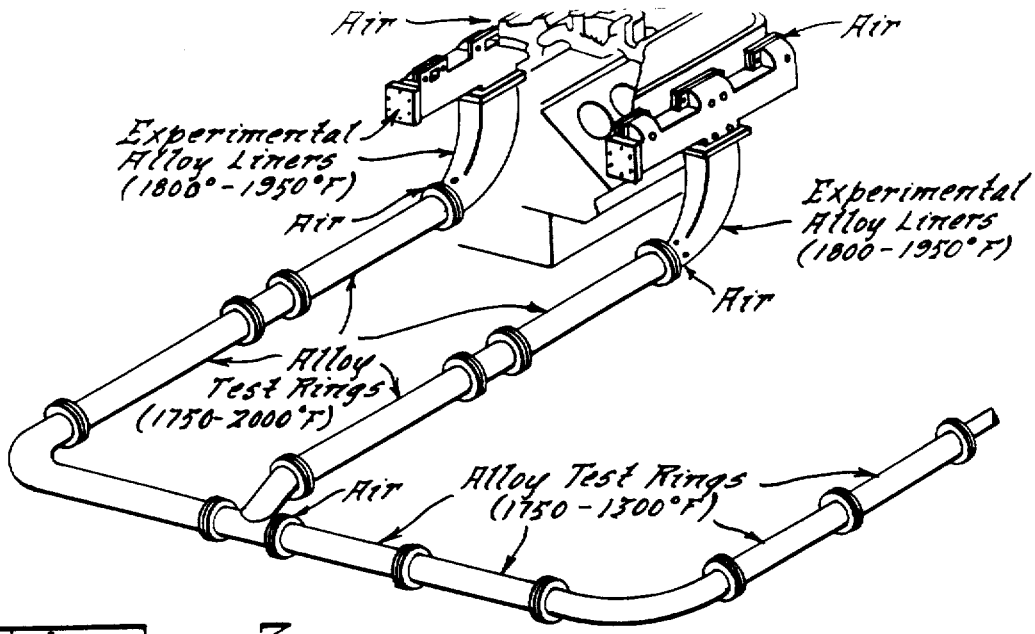
FIG. 3 illustrates an engine dynamometer installation for alloy evaluation.

Referring to FIG. 3, alloy test rings were utilized in various segments of an engine/dynamometer installation. Also employed were experimental alloy liners on exhaust manifolds of the engine driving the dynamometer. FIG. 3 is a schematic drawing of the alloy test ring pipe arrangement. The test conditions were controlled readily by injecting air at strategic points in the manifold, and adjusting carburetor jets to produce desired carbon monoxide levels and robot control of engine speed, load, spark and air injection.

Figure 4:
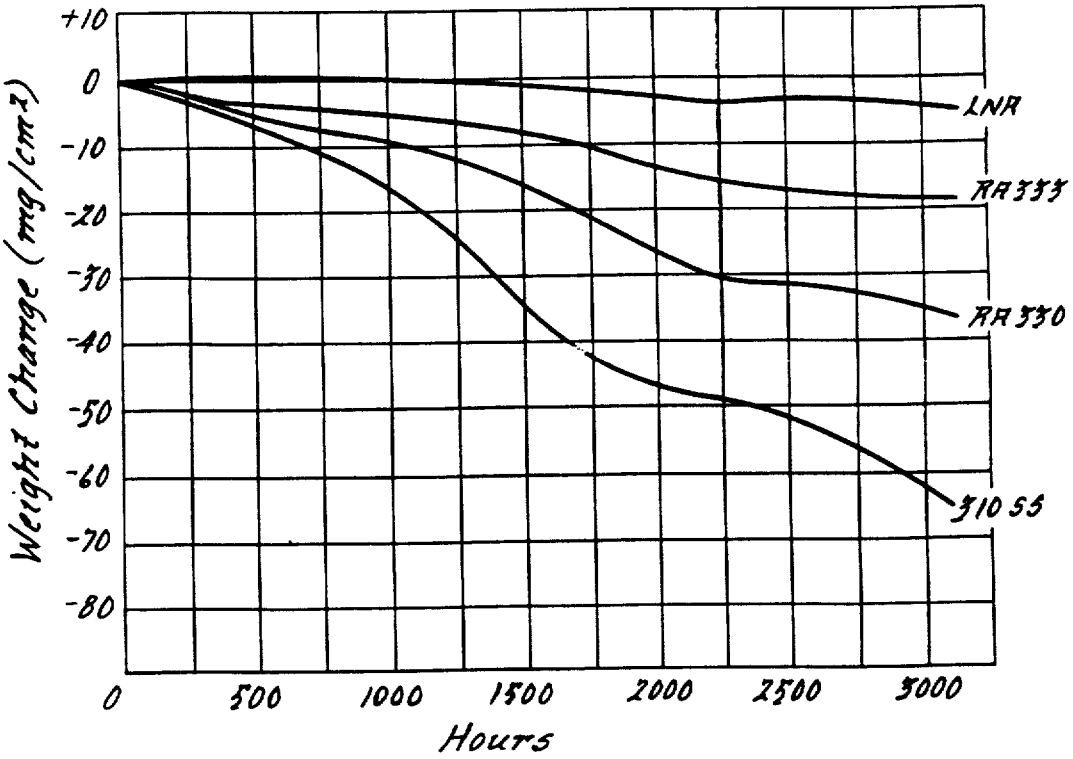
FIG. 4 shows the cyclic oxidation resistance of high-temperature alloy rings tested on an engine dynamometer at 1,800 to 1,900 degrees F (982 to 1,038 degrees C) oxidizing exhaust atmosphere, unleaded fuel.

The results of the 1800–1900 degrees F. oxidizing exhaust atmosphere, unleaded fuel engine/dynamometer testing is shown in FIG. 4, further indicating a superior performance of the LNA alloy disclosed herein.

The type and degree of corrosive attack observed on LNA following exposure to engine exhaust at 1800 to 1950 degrees F. is shown in the unetched photomicrograph of FIG. 5. The absence of substantial grain boundary oxidation is evidence of restricted anion (0−) migration typical of alloys of this invention. As a comparison, the type and degree of corrosive attack observed on commercial alloy RA333 following similar engine exhaust exposure is shown in the unetched photomicrograph of FIG. 6. The presence of extensive grain boundary oxidation is evidence of anion (0−) migration through the protective oxide scale.

Although elements from Groups IA, IIA and IIIB of the Periodic Table of Elements are the active ingredients in this dopant concept, other elements such as Y, Si and Al have shown second order interaction benefits with the dopants. While not intending to be bound by theory, this is thought to be due to their contribution to the formation of a stable host oxide along with the other active oxide formers such as chromium, nickel and iron. Both Al and Si are strong ferrite formers and their presence required the further addition of nitrogen as an austenitic stabilizer to maintain the required austenitic microstructure. Accordingly, aluminum can be effective as a dopant when employed at levels below those typically taught in the art and necessary to employ it as an oxide former.

Figure 7:
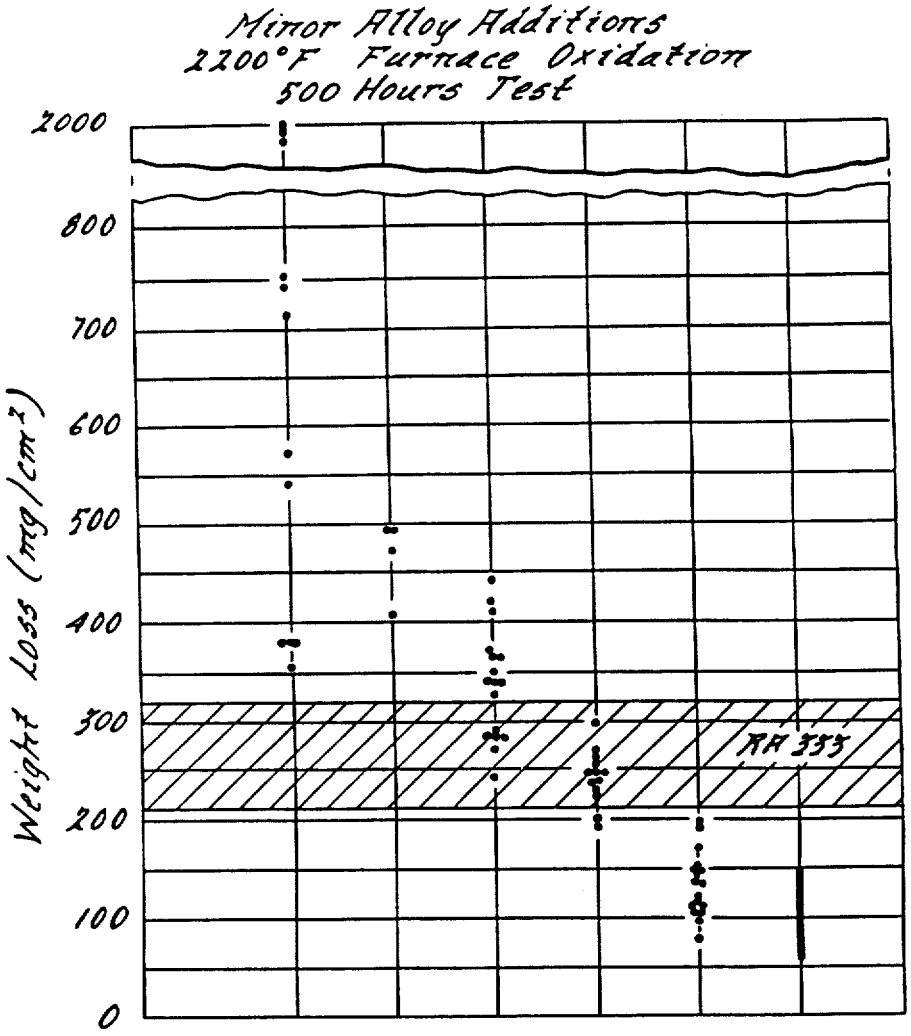
FIG. 7 shows the progressive improvement in oxidation resistance of alloys of this invention as a result of dopant additions.

FIG. 7 illustrates the progressive improvement in cyclic oxidation resistance of the alloys of this invention as additional dopant elements were introduced. As can be seen, the final low nickel austenitic alloy, with oxidation resistance superior to commercial RA333 contained dopants from the group of elements Li, Na, K, Mg, Ca, Ba and La, all of which are found in Groups IA, IIA or IIIB of the Periodic Table of Elements.

FIG. 7 summarizes the experimental-design development of these alloys. As explained earlier, oxidation resistance is generally characterized by weight loss per unit area of a 0.030" thick test panel shown as the ordinate. The band "RA333" represents a common commercial oxidation resistant austenitic alloy used as the standard of reference in all oxidation tests. Tabulated along the abscissa are two rows of elements designations. The "investigated" row identifies those elements selected by the fractional factorial experiment to be of potential interest and worthy of incorporation into detailed full factorial experimental schemes. The "accepted" row identifies those elements which were found to offer significant improvements in oxidation resistance following detailed analysis of full factorial experiments. Moving from left to right on FIG. 7 indicates steady progress in both oxidation resistance and reduction in variability of performance within this class of alloy The rightmost bar, representing final alloys of this research, encompass alloys of exceptional oxidation resistance containing one or more of the "accepted" elements as detailed in the claims. Note that elements included have been previously specified as austenite stabilizers (1), oxide formers (2) and/or dopants (3). The La-Ce interaction which persists throughout all final alloys evaluated is indicated in FIG. 7 to illustrate the nature of interactions. First evaluated in the second full factorial experiment, it was rejected as non-significant. However, in the 5th and 6th full factorial experiments it was found to interact significantly with the effect of dopants Mg, Ca, Na, Li, K, Ba and, therefore, selected as an addition to alloys of the final compositions.

While the present invention has been disclosed in connection with the preferred embodiment thereof, it should be understood that there may be other embodiments which fall within the spirit and scope of the invention and that the invention is susceptible to modification, variation and change without departing from the proper scope or fair meaning of the following claims.

I claim:

1. A crystalline iron-base alloy composition exhibiting improved resistance to oxidation, comprising:

(i) iron;
(ii) chromium;
(iii) silicon;
(iv) magnesium at a level of about 0.1 to about 1.5 percent, by weight of the final composition;
(v) calcium at a level of about 0.1 to about 1.5 percent, by weight of the final composition; and
(vi) an amount of a dopant element sufficient to show a significant and reproducible improvement in one or more oxidation resistant properties of the final composition selected from the group consisting of sodium, lithium, potassium and mixtures thereof.

2. A composition according to claim 1 further comprising barium.

3. A composition according to claim 1 further comprising yttrium.

4. A composition according to claim 1 further comprising lanthanum.

5. A composition according to claim 1 further comprising cerium.

6. A composition according to claim 1 further comprising aluminum.

7. A composition according to claim 1 further comprising beryllium.

8. A composition according to claim 1 further comprising strontium.

9. A composition according to claim 1 wherein the dopant element is present at a level of at least about 0.02 percent, by weight of the final composition.

10. A composition according to claim 9 wherein the dopant element is present at a level of about 0.05 to about 5 percent, by weight of the final composition.

11. A composition according to claim 10 wherein the dopant element is present at a level of about 0.1 to about 3.5 percent, by weight of the final composition.

12. A composition according to claim 11 wherein the dopant element is present at a level of about 0.1 to about 2.0 percent, by weight of the final composition.

13. A composition according to claim 1 wherein said chromium is present at a level of about 10 to about 30 percent, by weight of the final composition.

14. A composition according to claim 1 wherein the dopant element comprises lithium.

15. A composition according to claim 1 wherein the dopant element comprises sodium.

16. A composition according to claim 1 wherein the dopant element comprises potassium.

17. A composition according to claim 1 further comprising manganese.

18. A composition according to claim 1 further comprising cobalt.

19. A composition according to claim 1 further comprising nitrogen.

20. A composition according to claim 1 further comprising nickel.

21. A composition according to claim 20 wherein said nickel is present at a level of about 5 to about 15 percent, by weight of the final composition.

22. A crystalline iron-base alloy composition exhibiting improved resistance to oxidation, comprising:

(i) iron;

(ii) chromium;

(iii) silicon;

(iv) an amount of a first dopant element sufficient to show a significant and reproducible improvement in one or more oxidation resistant properties of the final composition selected from the group consisting of magnesium, calcium, and mixtures thereof; and (v) a second dopant element selected from the group consisting of sodium at a level of about 0.1 to about 0.5 percent, by weight of the final composition, lithium at a level of about 0.1 to about 0.5 percent, by weight of the final composition, potassium at a level of about 0.5 to about 1.0 percent, by weight of the final composition, and mixtures thereof.

23. A composition according to claim 22 further comprising barium.

24. A composition according to claim 22 further comprising yttrium.

25. A composition according to claim 22 further comprising lanthanum.

26. A composition according to claim 22 further comprising cerium.

27. A composition according to claim 22 further comprising aluminum.

28. A composition according to claim 22 further comprising beryllium.

29. A composition according to claim 22 further comprising strontium.

30. A composition according to claim 22 wherein the first dopant element is present at a level of at least about 0.02 percent, by weight of the final composition.

31. A composition according to claim 22 wherein the first dopant element is present at a level of about 0.05 to about 5 percent, by weight of the final composition.

32. A composition according to claim 31 wherein the first dopant element is present at a level of about 0.1 to about 3.5 percent, by weight of the final composition.

33. A composition according to claim 32 wherein the first dopant element is present at a level of about 0.1 to about 2.0 percent, by weight of the final composition.

34. A composition according to claim 22 wherein said chromium is present at a level of about 10 to about 30 percent, by weight of the final composition.

35. A composition according to claim 22 wherein the second dopant element comprises lithium.

36. A composition according to claim 22 wherein the second dopant element comprises sodium.

37. A composition according to claim 22 wherein the second dopant element comprises potassium.

38. A composition according to claim 22 wherein the first dopant element comprises calcium.

39. A composition according to claim 22 wherein the first dopant element comprises magnesium.

40. A composition according to claim 22 further comprising nickel.

41. A composition according to claim 40 wherein said nickel is present at a level of about 5 to about 15 percent, by weight of the final composition.

42. A composition according to claim 22 further comprising cobalt.

43. A composition according to claim 22 further comprising manganese.

44. A composition according to claim 22 further comprising nitrogen.

45. A crystalline iron-base alloy composition exhibiting improved resistance to oxidation consisting essentially of:

(i) iron;

(ii) at least one alloy element selected from the group consisting of nickel, chromium, molybdenum, manganese, silicon, carbon, vanadium, cobalt, copper, nitrogen, aluminum, titanium, zirconium, and mixtures thereof;

(iii) magnesium at a level of about 0.1 to about 0.5 percent, by weight of the final composition;

(iv) calcium at a level of about 0.1 to about 0.5 percent, by weight of the final composition; and (v) an amount of a dopant element sufficient to show a significant and reproducible improvement in one or more oxidation resistant properties of the final composition selected from the group consisting of sodium, lithium, potassium and mixtures thereof.

46. A composition according to claim 45 wherein the dopant comprises lithium at a level of 0.1 to about 0.5 percent, by weight of the final composition.

47. A composition according to claim 45 wherein the dopant comprises sodium at a level of 0.1 to about 0.5 percent, by weight of the final composition.

48. A composition according to claim 45 wherein the dopant comprises potassium at a level of about 0.1 to about 1.0 percent, by weight of the final composition.

49. A crystalline iron-base alloy composition exhibiting improved resistance to oxidation consisting essentially of:

(i) iron;

(ii) at least one alloy element selected from the group consisting of silicon, nickel, chromium, manganese, cobalt, nitrogen, and mixtures thereof; and (iii) magnesium, calcium, lithium, sodium, and potassium, wherein said magnesium is present at a level of about 0.1 to about 0.5 percent, said calcium is present at a level of about 0.1 to about 0.5 percent, said lithium is present at a level of about 0.1 to about 0.5 percent, said sodium is present at a level of about 0.1 to about 0.5 percent, and said potassium is present at a level of about 0.1 to about 1.0 percent by weight of the final composition.

* * * * *

UNITED STATES PATENT AND TRADEMARK OFFICE

CERTIFICATE OF CORRECTION

PATENT NO. : 4,999,158,

DATED : March 12, 1991

INVENTOR(S) : John M. Corwin

It is certified that error appears in the above-identified patent and that said Letters Patent is hereby corrected as shown below:

The sheets of drawings consisting of Figs. 1-7, should be added as shown on the attached pages.

On the title page, "No Drawing" should read -- 4 drawings --.

Signed and Sealed this

Twenty-fourth Day of November, 1992

*Attest:*

DOUGLAS B. COMER

*Attesting Officer*

*Acting Commissioner of Patents and Trademarks*

FIG. 6.
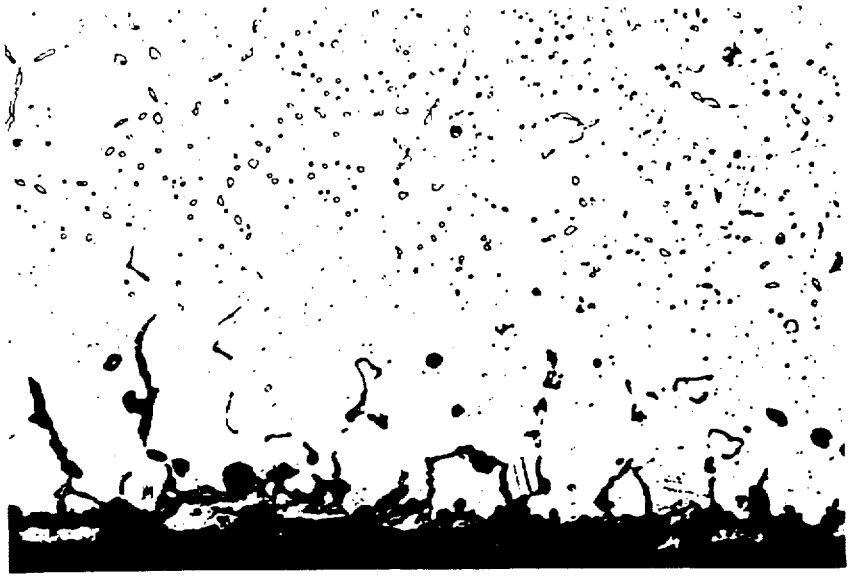
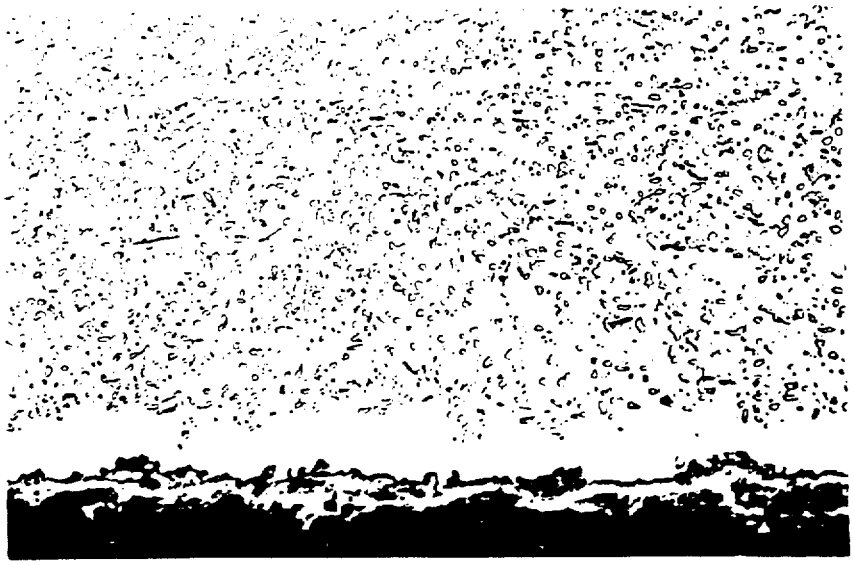
FIG. 5.

| | | | | | | |
|---|---|---|---|---|---|---|
| Investigated | Si<br>Mo<br>Y | Si<br>Lace | Mg<br>Si<br>Ti | Si<br>Ca<br>Y | B<br>Al<br>Lace | N<br>Al<br>Lace<br>Na<br>Li<br>K<br>Ba |
| Accepted | Si | Si | Si<br>Mg | Si<br>Mg<br>Ca<br>Y | Si<br>Mg<br>Ca<br>Lace<br>Al | Si<br>Mg<br>Ca<br>Lace<br>Al<br>N<br>Na<br>Li<br>K<br>Ba |